US009882285B2

(12) United States Patent
Nusseibeh

(10) Patent No.: US 9,882,285 B2
(45) Date of Patent: Jan. 30, 2018

(54) DIELECTRIC HOLLOW ANTENNA

(71) Applicant: Honeywell International Inc., Morristown, NJ (US)

(72) Inventor: Fouad Nusseibeh, Champlin, MN (US)

(73) Assignee: Honeywell International Inc., Morris Plains, NJ (US)

( * ) Notice: Subject to any disclaimer, the term of this patent is extended or adjusted under 35 U.S.C. 154(b) by 93 days.

(21) Appl. No.: 14/260,566

(22) Filed: Apr. 24, 2014

(65) Prior Publication Data

US 2015/0311596 A1 Oct. 29, 2015

(51) Int. Cl.

| | |
|---|---|
| ***H01Q 13/24*** | (2006.01) |
| ***H01Q 1/22*** | (2006.01) |
| *H01Q 13/28* | (2006.01) |
| *H01Q 13/02* | (2006.01) |
| *H01Q 19/08* | (2006.01) |
| *H01Q 13/20* | (2006.01) |

(52) U.S. Cl.

CPC ..... *H01Q 13/24* (2013.01); *H01Q 1/225* (2013.01); *H01Q 13/02* (2013.01); *H01Q 13/20* (2013.01); *H01Q 13/28* (2013.01); *H01Q 19/08* (2013.01)

(58) Field of Classification Search

CPC ..... H01Q 13/24; H01Q 1/225; H01Q 15/08; H01Q 15/10; H01Q 13/28; H01Q 13/20; H01Q 13/02; H01Q 19/08

USPC ..... 343/785–786, 900–904; 29/600

See application file for complete search history.

(56) References Cited

U.S. PATENT DOCUMENTS 3,154,784 A * 10/1964 Allen ..... H01Q 3/44 342/361
3,975,695 A * 8/1976 Hartman ..... H01P 5/04 333/230
4,274,097 A * 6/1981 Krall ..... H01Q 13/24 343/719
4,433,228 A * 2/1984 Nishimatsu ..... H01J 37/32192 219/121.36

(Continued)

OTHER PUBLICATIONS

Journal of Research of the National Bureau of Standards (vol. 51, No. 4). Oct. 1953.*

(Continued)

*Primary Examiner* — Hoang Nguyen
*Assistant Examiner* — Awat Salih
(74) *Attorney, Agent, or Firm* — Richard H. Krukar; Kermit D. Lopez; Luis M. Ortiz

(57) ABSTRACT

A dielectric hollow antenna apparatus includes a hollow inside tapered rod (e.g., a waveguide) with a flat section and a cap. The antenna further includes a feed through section, a feed pin, and a metal flange. A low loss dielectric material fills the hollow rod that protrudes beyond the metal waveguide to form a radiating element. The radiating element is designed in such a way to maximize radiation and minimize reflections over the antenna bandwidth. The feed through section reduces internal reflection and the waveguide is designed to include a rectangular waveguide that support a propagation (TE01) mode and the waveguide then transitions to a circular waveguide that supports another propagation (TE11) mode. The antennas can be employed for radar level gauging and withstand high temperature and possesses a small diameter that permits the antenna to fit in small tank nozzles.

17 Claims, 4 Drawing Sheets

(56) References Cited

U.S. PATENT DOCUMENTS 4,468,672 A * 8/1984 Dragone ..... H01Q 13/0208 333/240
4,665,660 A * 5/1987 Jablonski ..... B24B 1/00 29/600
5,248,987 A * 9/1993 Lee ..... H01Q 19/08 343/772
5,684,495 A * 11/1997 Dyott ..... H01Q 19/09 333/21 R
5,793,334 A * 8/1998 Anderson ..... H01Q 13/02 333/126
5,793,335 A * 8/1998 Anderson ..... H01Q 13/02 333/126
5,818,396 A * 10/1998 Anderson ..... H01Q 13/02 333/126
5,907,309 A * 5/1999 Anderson ..... H01P 1/161 333/248
5,936,589 A * 8/1999 Kawahata ..... H01Q 13/24 343/785
6,026,331 A * 2/2000 Feldberg ..... A61B 18/18 600/2
6,155,112 A * 12/2000 Eckert ..... G01F 23/284 343/753
6,202,485 B1 * 3/2001 Wien ..... G01F 23/284 324/642
6,480,141 B1 * 11/2002 Toth ..... G01N 22/00 324/639
6,903,692 B2 6/2005 Kivekäs et al.
6,927,734 B2 * 8/2005 Serban ..... G01F 23/284 324/644
7,075,480 B2 7/2006 Fehrenbach et al.
7,499,001 B2 3/2009 Fujieda
8,040,274 B2 10/2011 Wendler et al.
8,354,970 B2 1/2013 Armbrecht et al.
8,593,362 B2 * 11/2013 Shea ..... H01Q 13/065 343/779
2002/0080080 A1 * 6/2002 Kloefer ..... G01F 23/284 343/785
2002/0126061 A1 9/2002 Griessbaum et al.
2004/0056667 A1 * 3/2004 Lutke ..... G01F 23/284 324/644
2005/0025480 A1 10/2005 Fehrenbach et al.
2009/0058301 A1 3/2009 Fuks et al.
2009/0212996 A1 * 8/2009 Chen ..... H01Q 13/02 342/124
2009/0303106 A1 * 12/2009 Edvardsson ..... G01F 23/284 342/124
2010/0066594 A1 * 3/2010 Kienzle ..... G01F 23/284 342/175
2010/0295745 A1 * 11/2010 Armbrecht ..... H01Q 1/225 343/785
2012/0060600 A1 * 3/2012 Reimelt ..... G01F 23/284 73/290 V
2012/0137768 A1 * 6/2012 Edvardsson ..... H01Q 1/225 73/290 V
2012/0186339 A1 * 7/2012 Feisst ..... G01F 23/284 73/290 V
2012/0242553 A1 9/2012 Leung et al.
2013/0234898 A1 9/2013 Leung et al.
2013/0269430 A1 10/2013 Mauduit et al.
2014/0047917 A1 * 2/2014 Vogt ..... G01F 23/284 73/290 V
2014/0085131 A1 3/2014 Widahl et al.
2015/0061947 A1 * 3/2015 Manry, Jr. ..... H01Q 1/22 343/720
2015/0276459 A1 * 10/2015 Sai ..... G01F 23/284 73/290 V
2016/0195593 A1 * 7/2016 Purea ..... G01R 33/282 324/322

OTHER PUBLICATIONS

The ARRL Antenna Book.*
PCT International Search Report dated Jun. 30, 2015 for PCT/US2015/024855.
Armbrecht, G. et al., "Dielectric Tube Antennas for Industrial Radar Level Gauging," IEEE Transactions on Antennas and Propagation (2012) 60(11):5083-5091.
Kumar, C. et al., "Design of Short Axial Length High Gain Dielectric Rod Antenna," IEEE Transactions on Antennas and Propagation (2010) 58(12):4066-4069.

* cited by examiner

DIELECTRIC HOLLOW ANTENNA

FIELD OF THE INVENTION

Embodiments are generally related to dielectric antennas. Embodiments are also related to radar antennas. Embodiments are additionally related to a dielectric hollow antenna.

BACKGROUND

A dielectric antenna such as a dielectric rod antenna is a surface-wave antenna in which an end-fire radiation pattern is produced by propagation of a surface wave on a tapered dielectric rod. Dielectric rod antennas provide significant performance advantages and are low cost alternatives to free space high-gain antennas at millimeter-wave frequencies and the higher end frequencies of the microwave band. Conventional dielectric antennas required for radar level gauging do not withstand high temperatures. Additionally, such antennas must be installed via small tank nozzles which can affect gain, return loss, and side lobes over the radar bandwidth issues.

Based on the foregoing, it is believed that a need exists for an improved dielectric hollow antenna, which will be described in greater detail herein.

SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved dielectric antenna.

It is another aspect of the disclosed embodiments to provide for a dielectric hollow antenna capable of withstanding high temperatures, maximizing radiation, and minimizing reflections over the antenna bandwidth.

The aforementioned aspects and other objectives and advantages can now be achieved as described herein. A dielectric hollow antenna is disclosed, which includes a hollow inside tapered rod with a flat section and a cap to form a waveguide. The antenna is further configured to include a feed through section, a feed pin, and a metal flange, A low loss dielectric material (e.g., Teflon, a notoriously well-known PTFE (polytetrafluoroethylene) based material) can fill the hollow rod that protrudes beyond the metal waveguide to form a radiating element. The radiating element is designed in such a manner as to maximize radiation and minimize reflections over the antenna bandwidth. The feed through section reduces internal reflection and the waveguide can be designed as a rectangular waveguide that supports a propagation (TE01) mode. The waveguide can then transition to a circular waveguide that supports another propagation (TE11) mode.

The end of the hollow rod can be tapered so as to converge towards the end of the antenna. The feed pin guides the waves from the feed through section into the hollow inside tapered rod. The antenna can be configured utilizing a single dielectric material capable of withstanding high temperatures while possessing a small diameter that permits the antenna to fit in, for example, a small tank nozzle. The antenna can be employed for radar level gauging applications that involve a high gain, a very low return loss, and low side lobes over the radar bandwidth.

BRIEF DESCRIPTION OF THE FIGURES

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As required, detailed embodiments are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the disclosed embodiments.

Figure 1:
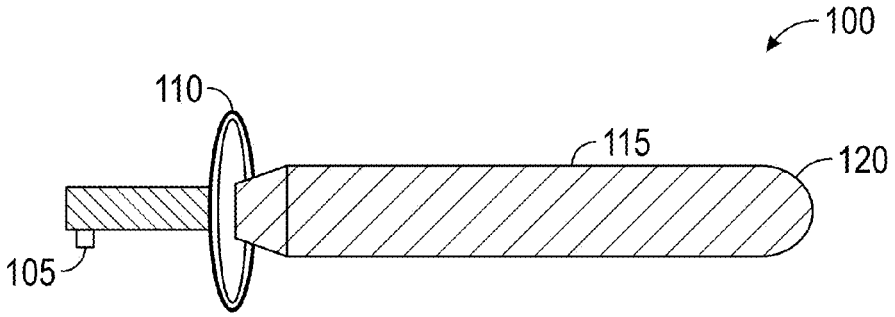
FIG. 1 illustrates a perspective view of a dielectric hollow antenna, in accordance with the a preferred embodiment.
Figure 2:
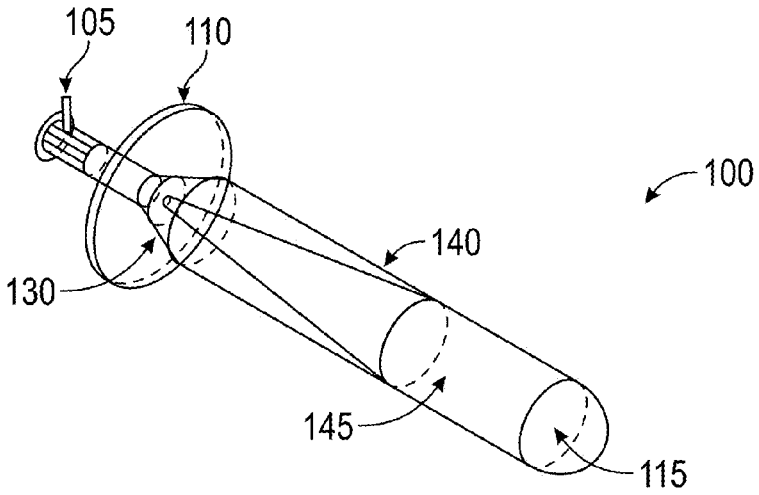
FIG. 2 illustrates an exploded view of the dielectric hollow antenna, in accordance with a preferred embodiment.
Figure 3:
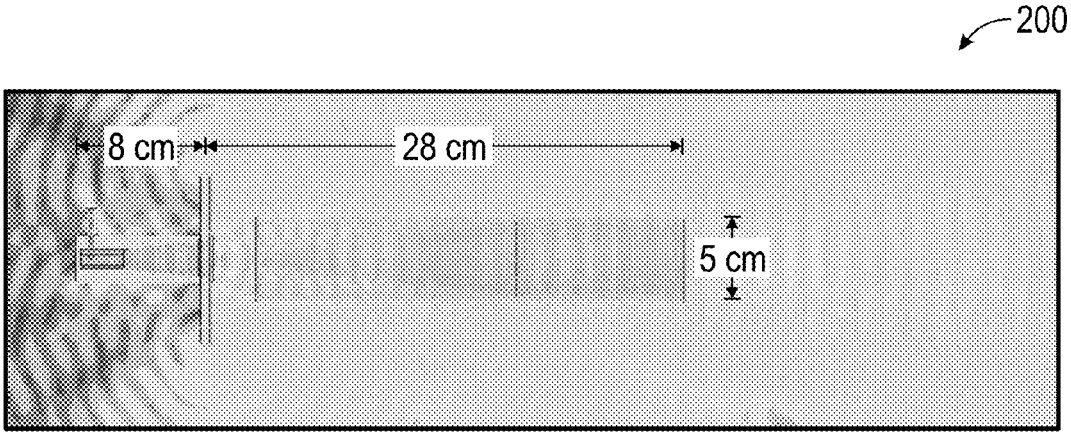
FIG. 3 illustrates an electric field radiation with respect to the dielectric hollow antenna, in accordance with a preferred embodiment.

FIG. 1 illustrates a perspective view of a dielectric hollow antenna 100, in accordance with a preferred embodiment. The dielectric hollow antenna 100 includes a hollow inside tapered rod (waveguide) 115 with a flat section and a cap 120 at the end of the dielectric hollow antenna. The antenna 100 further includes a feed through section 130, a feed pin 105, and a metal flange 110. A low loss dielectric material 10 can fill the hollow rod 115 and protrude beyond the metal waveguide 115 to form a radiating element 145. Note that radiating element 145, as shown in FIG. 2, extends beyond hollow rod 115 but, as seen in FIG. 3, is of a single piece with the dielectric material filling hollow rod 115. The end of the hollow rod 115 can be internally tapered so as to converge towards the feed through end of the antenna 100 as seen in FIGS. 2-3. The converging tapered end of the rod 115 improves matching in regard to wave propagation characteristics when the wave is guided from the feed through section 110 to the dielectric hollow rod 115. The feed pin 105 can guide the waves from the feed through section 110 into the hollow inside tapered rod 115.

FIG. 2 illustrates an exploded view of the dielectric hollow antenna 100, in accordance with a preferred embodiment. The dielectric rod 100 can be gradually tapered to form a tapered section 140 from the maximum diameter portion to the cap portion 120. Note that the hollow rod can be formed of, for example, Teflon material, depending upon design consideration. It can be appreciated of course that the embodiments described herein are not limited to the use of Teflon, but may be configured to include the use of other types of materials. The radiating element 145 can be configured in such a way as to maximize radiation and minimize reflections over the antenna bandwidth.

FIG. 3 illustrates an electric field radiation pattern 200 with respect to the dielectric hollow antenna 100, in accordance with the disclosed embodiments. Note that the feed through section 130 will be the part of the antenna 100. The feed through section 130 reduces internal reflection and the waveguide 115 comprises a rectangular waveguide that supports a propagation (TE01) mode and the waveguide then transitions to a circular waveguide that supports another propagation (TE11) mode.

Figure 4:
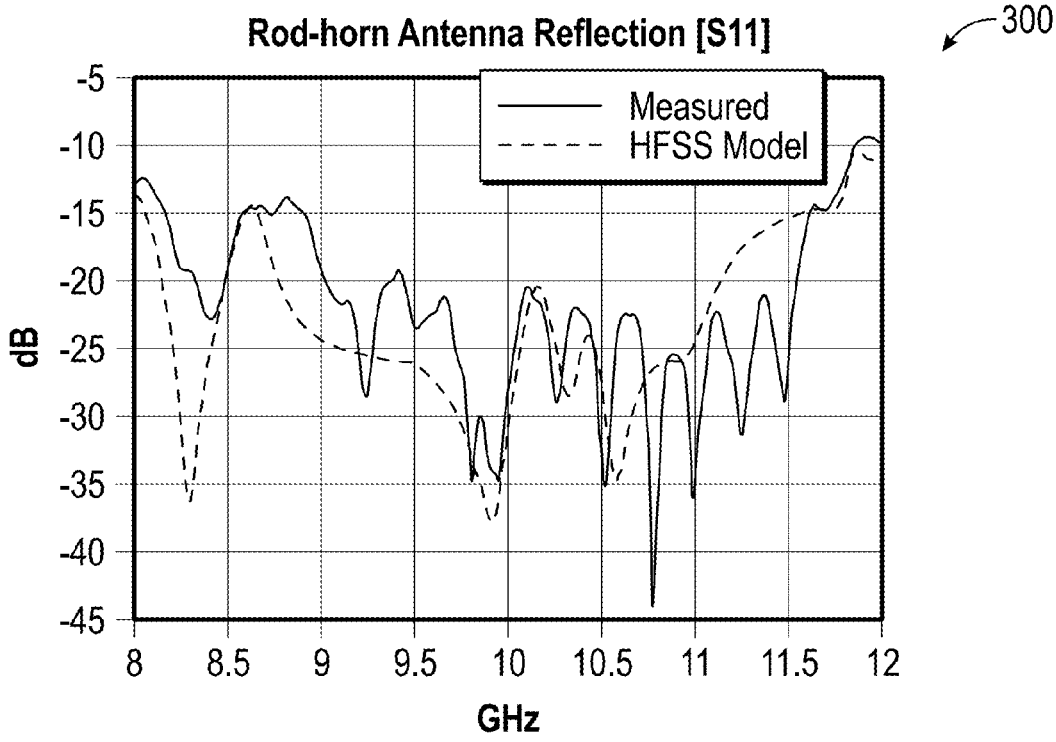
FIG. 4 illustrates a graphical representation of a reflection model and measurement with respect to the dielectric hollow antenna, in accordance with alternative embodiments.

FIG. 4 illustrates a graphical representation 300 of a reflection model and measurement with respect to the dielectric hollow antenna 100, in accordance with an alternative embodiment. In general, a port can be loosely defined as any place where voltage and current is delivered. So, if communication system with two radios (radio 1 and radio 2), then the radio terminals (i.e., which deliver power to the two antennas) can be the two ports. S11 represents the reflected power radio 1 is trying to deliver to antenna 1. S11 of the dielectric hollow antenna 100 is −21 dB over bandwidth (e.g. 9.5-10.5) GHz (e.g. target<=−15 dB).

Figure 5:
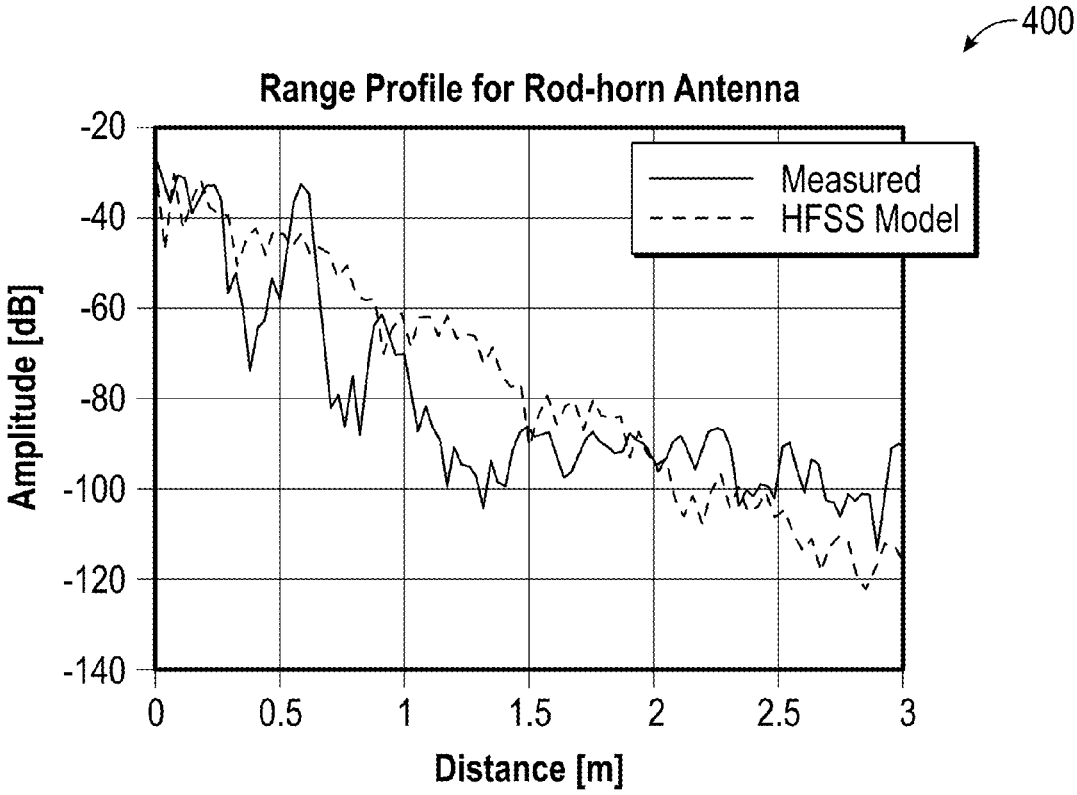
FIGS. 5-6 illustrates a graphical representation of a distance profile with respect to the dielectric hollow antenna, in accordance with alternative embodiments.
Figure 6:
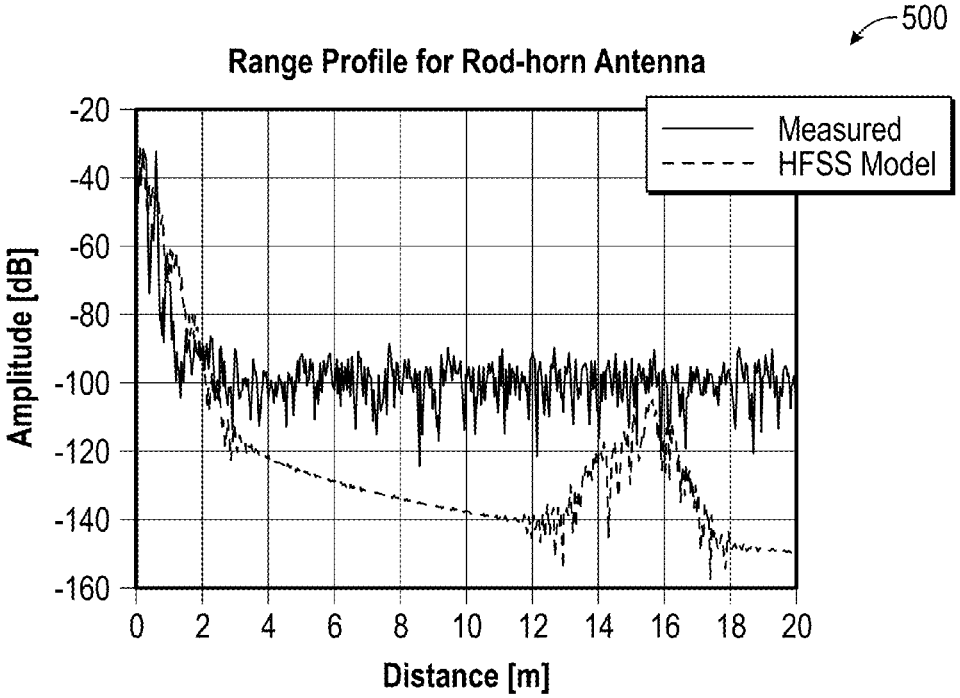

FIGS. 5-6 illustrate a graphical representation of a distance profile 400 and 500 over 3 m and 20 m with respect to the dielectric hollow antenna 100, in accordance with an alternative embodiment. The dielectric hollow antenna 100 can be designed using single dielectric material that can withstand high temperatures and possesses a small diameter that permits the dielectric hollow antenna 100 to fit in small tank nozzles. The simplest way to define the width of a beam is to choose two diametrically opposite points at which the irradiance is a specified fraction of the beam's peak irradiance, and take the distance between them as a measure of the beam's width. An obvious choice for this fraction is ½ (−3 dB), in which case the diameter obtained is the full width of the beam at half its maximum intensity (FWHM). This is also called the half-power beam width (HPBW). The half-power beam width (HPBW) of the dielectric hollow antenna 100 is 180 (target 160), diameter of 5 cm (target<=10 cm).

Figure 7:
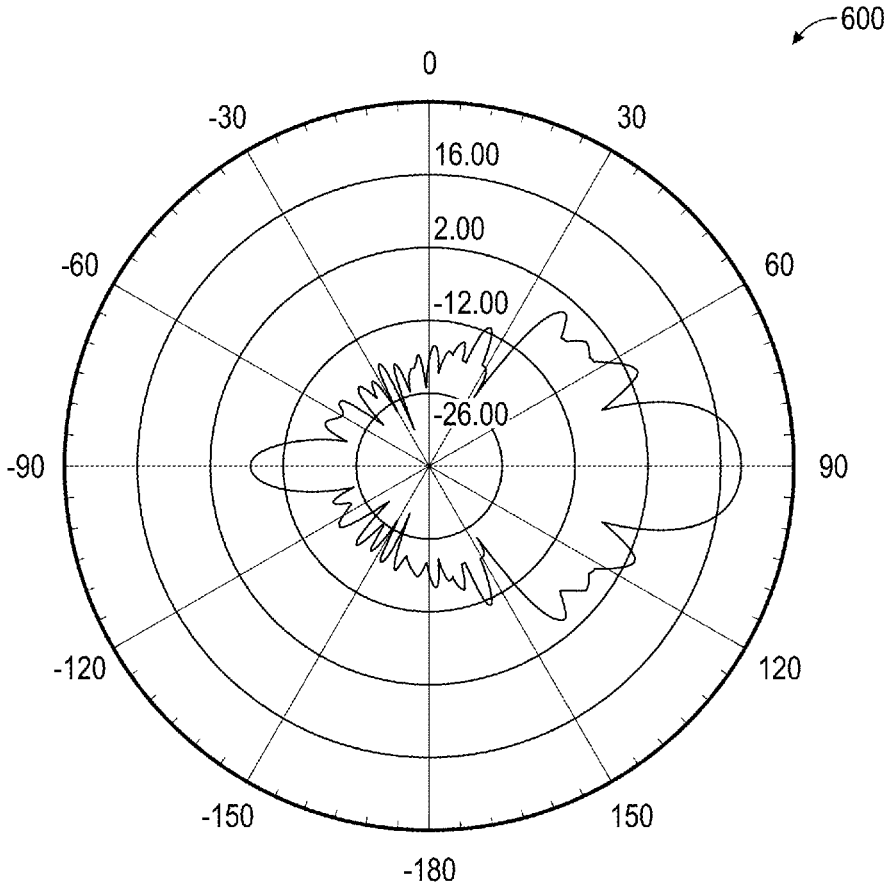
FIG. 7 illustrates a graphical representation of a directivity radiation pattern with respect to the dielectric hollow antenna, in accordance with alternative embodiments.

FIG. 7 illustrates a graphical representation of a directivity radiation pattern 600 with respect to the dielectric hollow antenna 100, in accordance with an alternative embodiment. The directivity radiation pattern 600 of the hollow antenna 100 is 20.5 db with a target of 21 db. The dielectric hollow antenna 100 can withstand high temperature and can be installed through the small tank nozzle. The dielectric hollow antenna 100 can be readily adapted to radar level gauging, while offering a comparatively low cost of construction, and can be readily assembled. Antenna 100 also presents a low risk of damage to the electronics during assembly or operation, is accurate and reliable in operation, and is more readily cleaned than known prior art devices. When utilized in the context of the preferred embodiment illustrated and described herein above, the apparatus 100 can offer high gain, very low return loss, and low side lobes over the radar bandwidth.

Based on the foregoing, it can be appreciated that a number of embodiments, preferred and alternative, are disclosed herein. For example, in one embodiment, a dielectric hollow antenna apparatus can be implemented, which includes, for example: a waveguide configured from a hollow inside tapered rod with a flat section and a cap; a low loss dielectric material located within the hollow inside tapered rod, which protrudes beyond the waveguide to form a radiating element; and a feed through section, a feed pin, and a metal flange, wherein the feed through section reduces an internal reflection, and the antenna is installed via a tank nozzle for radar level gauging and to withstand high temperatures.

In another embodiment, the aforementioned waveguide can include or be configured as a waveguide that supports a TE01 propagation mode and then transitions to a circular waveguide that supports a TE11 propagation mode. In yet another embodiment, the radiating element can be configured to maximize radiation and minimize reflection over an antenna bandwidth. In still another embodiment, the dielectric material can be a material capable of withstanding high-temperatures. In yet another embodiment, the hollow tapered rod can include a small diameter that permits the antenna to fit in the small tank nozzle. In still another embodiment, the antenna can provide or include a high gain, a very low return loss, and a low side lobe over a radar bandwidth.

In another embodiment, a method of configuring a dielectric hollow antenna can be implemented, which includes the steps or logical operations of providing a waveguide configured from a hollow inside tapered rod with a flat section and a cap; locating a low loss dielectric material within the hollow inside tapered rod, which protrudes beyond the waveguide to form a radiating element; and forming a feed through section, a feed pin, and a metal flange, wherein the feed through section reduces an internal reflection, and the antenna is installed via a tank nozzle for radar level gauging and to withstand high temperatures.

It will be appreciated that variations of the above-disclosed and other features and functions, or alternatives thereof, may be desirably combined into many other different systems or applications. It will also be appreciated, that various presently unforeseen or unanticipated alternatives, modifications, variations or improvements therein may be subsequently made by those skilled in the art, which are also intended to be encompassed by the following claims.

The invention claimed is:

1. A dielectric hollow antenna apparatus, comprising:

a feed pin connected to an input section;

a feed through section passing a metal flange attached to the input section wherein the feed through section reduces an internal reflection;

a metal waveguide comprising a hollow inside tapered rod to form a radiating element having a tapering that widens with increasing longitudinal distance from the metal flange, the feed pin, the input section, and the feed through section;

a dielectric material filling the hollow inside tapered rod and extending past the hollow inside tapered rod; and wherein the metal waveguide comprises a first waveguide that supports a TE01 propagation mode and then transitions to a circular waveguide that supports a TE11 propagation mode.

2. The dielectric hollow antenna apparatus of claim 1 wherein the radiating element is configured to maximize radiation and minimize reflection at millimeter-wave frequencies.

3. The dielectric hollow antenna apparatus of claim 1 wherein the dielectric material comprises polytetrafluoroethylene.

4. The dielectric hollow antenna apparatus of claim 1 wherein the hollow tapered rod comprises a diameter that permits the antenna to fit in a tank nozzle.

5. The dielectric hollow antenna apparatus claim 1 wherein the antenna has a high gain, a very low return loss, and a low side lobe over a 9.5 GHz-10.5 GHz bandwidth.

6. The dielectric hollow antenna, apparatus of claim 1 wherein the feed pin is axially connected to the input section.

7. The dielectric hollow antenna apparatus of claim 1 wherein the hollow tapered rod comprises a diameter that permits the antenna to fit in the tank nozzle.

8. A dielectric hollow antenna apparatus, comprising:

a feed pin connected to an input section;

a feed through section passing a metal flange attached to the input section wherein the feed through section reduces an internal reflection;

a metal waveguide comprising a hollow inside tapered rod to form a radiating element having a tapering that widens with increasing longitudinal distance from the feed pin and from the input section;

a dielectric material filling the hollow inside tapered rod and extending longitudinally past the hollow inside tapered rod;

a cap on the end of the dielectric hollow antenna wherein the cap is on the dielectric material wherein the dielectric hollow antenna apparatus is sized to be installed via a tank nozzle for radar level gauging; and wherein the metal waveguide comprises a first waveguide that supports a TE01 propagation mode and then transitions to a circular waveguide that supports a TE11 propagation mode.

9. The dielectric hollow antenna apparatus of claim 8 wherein the dielectric material comprises polytetrafluoroethylene.

10. The dielectric hollow antenna apparatus, of claim 8 wherein the hollow tapered rod comprises a diameter that permits the antenna to fit in the tank nozzle.

11. The dielectric hollow antenna apparatus of claim 8 wherein the antenna comprises a high gain, a very low return loss, and a low side lobe over a 9.5 GHz-10.5 GHz bandwidth.

12. The dielectric hollow antenna apparatus of 8 wherein the feed pin axially is connected to the input section.

13. The dielectric hollow antenna apparatus of claim 1 wherein the hollow tapered rod comprises a diameter that permits the antenna to fit in the tank nozzle.

14. A method of configuring a dielectric hollow antenna, the method comprising:

attaching to an input section a feed through section passing a metal flange wherein the feed through section reduces an internal reflection within the dielectric hollow antenna;

providing a metal waveguide comprising a hollow inside tapered rod to form a radiating element having a tapering that widens with increasing longitudinal distance from the metal flange and from the input section wherein the feed through section is disposed between the input section and the metal flange;

locating a dielectric material within the hollow inside tapered rod, wherein the dielectric material fills the hollow inside tapered rod, and wherein the dielectric material protrudes longitudinally beyond the hollow inside tapered rod;

locating a cap on the end of the dielectric hollow antenna wherein the cap is on the dielectric material; and wherein the metal waveguide supports a TE01 propagation mode and then transitions to a circular waveguide that supports a TE11 propagation mode.

15. The method of claim 14 further comprising configuring the dielectric material to maximize radiation and minimize reflection over a 9.5 GHz-10.5 GHz bandwidth.

16. The method of claim 15 wherein the dielectric material comprises a polytetrafluoroethylene, wherein a feed pin is axially connected to the input section, and wherein the hollow tapered rod comprises a diameter that permits the antenna to fit in the tank nozzle.

17. The method of claim 14 wherein the antenna comprises a high gain, a very low return loss, and a low side lobe over a 9.5 GHz-10.5 GHz bandwidth.

* * * * *